US009328893B2

(12) United States Patent
Strotmann et al.

(10) Patent No.: US 9,328,893 B2
(45) Date of Patent: May 3, 2016

(54) LUMINAIRE WITH A LAMPSHADE

(71) Applicant: Glashutte Limburg Leuchten GmbH & Co. KG, Limburg (DE)

(72) Inventors: Heinz-Dieter Strotmann, Menden (DE); Jan Zellerhoff, Dortmund (DE)

(73) Assignee: GLASHUTTE LIMBURG LEUCHTEN GMBH & CO., KG, Limburg (DE)

( * ) Notice: Subject to any disclaimer, the term of this patent is extended or adjusted under 35 U.S.C. 154(b) by 0 days.

(21) Appl. No.: 14/494,494

(22) Filed: Sep. 23, 2014

(65) Prior Publication Data

US 2015/0085483 A1 Mar. 26, 2015

(30) Foreign Application Priority Data

Sep. 24, 2013 (EP) ..... 13004636

(51) Int. Cl.

| | |
|---|---|
| ***F21V 1/00*** | (2006.01) |
| ***F21V 11/00*** | (2015.01) |
| ***F21V 3/00*** | (2015.01) |
| ***F21S 8/06*** | (2006.01) |
| ***F21V 1/14*** | (2006.01) |
| ***F21K 99/00*** | (2016.01) |
| *F21Y 101/02* | (2006.01) |

(52) U.S. Cl.

CPC ... *F21V 1/00* (2013.01); *F21K 9/30* (2013.01); *F21S 8/06* (2013.01); *F21V 1/146* (2013.01); *F21V 3/00* (2013.01); *F21Y 2101/02* (2013.01)

(58) Field of Classification Search

CPC ..... F21V 1/00; F21V 1/14; F21V 1/26; F21V 1/146; F21V 11/00; F21V 8/04; F21V 8/033; F21V 17/00; F21V 17/164; F21V 5/04; F21V 3/00; F21S 48/145; F21S 8/06; F21K 9/30; F21Y 2101/02

USPC ..... 362/351, 359, 186, 220, 223, 307, 310, 362/311.01–311.15, 355–356, 391, 362/362–363, 376–377, 403, 407–408

See application file for complete search history.

(56) References Cited

U.S. PATENT DOCUMENTS

| | | | | |
|---|---|---|---|---|
| D218,474 | S * | 8/1970 | Devine, Jr. | D26/131 |
| 6,903,380 | B2 * | 6/2005 | Barnett et al. | 257/98 |
| 7,663,315 | B1 * | 2/2010 | Hulse | 313/512 |
| 7,686,478 | B1 * | 3/2010 | Hulse et al. | 362/255 |
| D628,740 | S * | 12/2010 | Arbel | D26/128 |
| 7,967,477 | B2 * | 6/2011 | Bloemen et al. | 362/299 |
| 8,075,157 | B2 * | 12/2011 | Zhang et al. | 362/249.02 |
| 8,348,482 | B1 | 1/2013 | Arbel | |
| 8,496,349 | B2 * | 7/2013 | Wu et al. | 362/249.02 |
| D695,442 | S * | 12/2013 | Speier et al. | D26/74 |

(Continued)

FOREIGN PATENT DOCUMENTS

| | | |
|---|---|---|
| CN | 202647579 U | 1/2013 |
| DE | 202012101697 U1 | 5/2012 |

*Primary Examiner* — Anne Hines
*Assistant Examiner* — Jose M Diaz
(74) *Attorney, Agent, or Firm* — Baker and Hostetler LLP

(57) ABSTRACT

A luminaire comprises a light source in the form of at least one LED, and a transparent lampshade having a closed light inlet end and an open light outlet end with a light outlet opening, the light source being arranged at the light inlet end, outside the lampshade. It is provided that the lampshade comprises a recess at the light inlet end which points to the light outlet opening.

15 Claims, 2 Drawing Sheets

(56) References Cited

U.S. PATENT DOCUMENTS

| | | | | |
|---|---|---|---|---|
| 8,975,806 | B2 * | 3/2015 | Kitagawa et al. | 313/110 |
| 2003/0223238 | A1 * | 12/2003 | Hsu et al. | 362/255 |
| 2010/0327302 | A1 * | 12/2010 | Wang et al. | 257/98 |
| 2012/0049737 | A1 * | 3/2012 | Kitagawa et al. | 315/53 |
| 2012/0086034 | A1 * | 4/2012 | Yuan et al. | 257/98 |
| 2012/0092852 | A1 * | 4/2012 | Doan et al. | 362/84 |
| 2012/0140486 | A1 * | 6/2012 | Chou | 362/311.02 |
| 2012/0287641 | A1 * | 11/2012 | Tsung | 362/294 |
| 2013/0010464 | A1 * | 1/2013 | Shuja et al. | 362/235 |
| 2013/0027926 | A1 * | 1/2013 | Chiu et al. | 362/235 |
| 2013/0170216 | A1 * | 7/2013 | Li | F21V 5/04 362/277 |
| 2013/0293098 | A1 * | 11/2013 | Li et al. | 313/512 |
| 2014/0043827 | A1 * | 2/2014 | Kim et al. | 362/311.02 |
| 2014/0212090 | A1 * | 7/2014 | Wilcox et al. | 385/27 |
| 2014/0233239 | A1 * | 8/2014 | Matsuda et al. | 362/294 |
| 2014/0328062 | A1 * | 11/2014 | Ikeda et al. | 362/237 |
| 2014/0355302 | A1 * | 12/2014 | Wilcox et al. | 362/609 |
| 2014/0369040 | A1 * | 12/2014 | Yen | 362/235 |
| 2015/0070897 | A1 * | 3/2015 | Chien | 362/269 |
| 2015/0092419 | A1 * | 4/2015 | De Visser et al. | 362/293 |
| 2015/0138821 | A1 * | 5/2015 | Kosuge et al. | 362/511 |

* cited by examiner

LUMINAIRE WITH A LAMPSHADE

CROSS-REFERENCE TO RELATED APPLICATION

This application claims priority to foreign European patent application No. EP 13004636.0, filed on Sep. 24, 2013, the disclosure of which is incorporated by reference in its entirety.

FIELD OF THE INVENTION

The present invention relates to a luminaire, in particular a pendant luminaire, according to the preamble of independent claim 1, and to a lampshade for a luminaire according to the preamble of independent claim 15. A generic luminaire comprises a light source in the form of at least one LED, and a transparent lampshade having a closed light inlet end and an open light outlet end with a light outlet opening. The light source is arranged at the light inlet end, outside the lampshade.

BACKGROUND

The prior art describes a plurality of luminaires having the light source arranged inside the lampshade. Conventional incandescent lamps or energy-saving lamps are used as light sources. Also, in order to achieve an even greater energy efficiency LEDs having special light-conducting attachments are partially used in conventional luminaires. The light-conducting attachments are necessary to obtain a similar radiation characteristic as conventional incandescent lamps.

In the meantime, pure LED luminaires are available which no longer permit the use of a conventional illuminant, but are exclusively designed for the use of LEDs. A luminaire of the above-mentioned type is known, for instance, from DE 20 2012 101 697 U1. The lampshade of this luminaire has a closed light inlet end, and is illuminated by several LEDs from outside. No illuminant is provided inside the lampshade. The light radiated from the LEDs arranged outside the lampshade is deflected in a suitable manner by a plano-convex lens at the light inlet end of the lampshade and emitted to the outside partially through the light outlet end, partially through the transparent lampshade. The LEDs are received in a housing which is attached and screwed to the lampshade.

It is a drawback of the luminaire known from DE 20 2012 101 697 U1 that the light radiated from the LEDs is not uniformly distributed, and that the optical appearance of the luminaire is negatively affected by the attached housing. The attached housing is furthermore in conflict with a compact construction of the luminaire. Also, the attachment is not suited for the use of SMD-LEDs.

SUMMARY OF THE INVENTION

It is the object of the present invention to provide a luminaire having an improved light distribution, a compact structure and an appealing appearance, whilst being variably usable for many different applications and producible at a cost minimum.

The object is achieved by the features of claim 1. Accordingly, in connection with a luminaire of the above-mentioned type, the object is solved in accordance with the invention if the lampshade comprises a recess at the light inlet end which points to the light outlet end.

In other words, the lampshade comprises an outer region having a substantially concave shape, and an inner region having a substantially convex shape thus constituting a recess relative to the outer region. This refers to the basic form of the two regions respectively, and not to the exact curvature in a mathematical sense. For instance, the outer region can also have a convex curvature in the area of the light outlet opening.

The recess is provided both on the outside and the inside of the lampshade. Consequently, both the outside and the inside of the lampshade have a convex curvature in the area of the recess. Preferably, the lampshade as a whole, in particular in the area of the recess, has substantially the same wall thickness. The wall thickness of the lampshade is preferably 3 to 10 mm.

Within the scope of the present application a transparent lampshade is both a completely transparent lampshade and a semi-transparent lampshade, or an opaque lampshade.

The height of the lampshade corresponds to the perpendicular distance between the plane of the light inlet end and the plane of the light outlet end. The width of the lampshade corresponds to the extension of the lampshade perpendicular thereto.

The light source of the luminaire according to the invention is formed of one LED or several LEDs. It is possible to use identical LEDs or different LEDs. Particularly suited are so-called SMD-LEDs which are directly soldered to a board.

The invention has the advantage that the LEDs can be received in the recess of the lampshade. This renders the luminaire very compact and visually appealing. The recess furthermore ensures a good mixing and distribution of the LED light so that no individual light sources are perceptible behind the lampshade. As a whole, the configuration of the luminaire according to the invention ensures a very homogenous illumination.

Advantageous embodiments of the present invention are defined in the dependent claims.

In one preferred embodiment of the present invention the height of the recess corresponds to at least 50% of the height of the lampshade. Thus, a very good distribution and mixing of the LED light is achieved, even if the lampshade has a relatively flat form. Moreover, it is thus possible that the LEDs are received inside the recess, whilst a relatively large distance of the LEDs to the wall of the recess can be observed so that the LEDs are not perceptible as individual light sources behind the lampshade. Therefore, the LEDs are preferably received in the first third of the recess that is directly adjacent to the light inlet opening.

It is particularly preferred that the height of the recess corresponds to at least 70%, preferably at least 80%, of the height of the lampshade. Thus, the above-described advantages are further enhanced.

In another preferred embodiment of the present invention the width of the recess corresponds to at least 25%, preferably at least 40%, of the width of the lampshade. Thus, too, a compact construction of the luminaire as well as sufficient space for accommodating the LEDs are realized. Preferably, the recess is arranged centrally so that the lampshade has a symmetrical structure and is aesthetically appealing.

In another preferred embodiment of the present invention the recess is substantially spherical or dome-shaped. It has shown that thus a particularly uniform light distribution can be obtained.

In another preferred embodiment of the present invention the outer region adjacent to the recess is substantially toroidal or cylindrical. Thus, a particularly appealing outer appearance is obtained and, at the same time, a pleasant illumination, respectively, light distribution.

Alternatively, also other geometrical shapes are conceivable for the recess and the outer region of the lampshade so as to adapt the luminaire to different photometric tasks.

In another preferred embodiment of the present invention the lampshade is made in one piece. This permits a particularly inexpensive production of the luminaire. The one-piece configuration of the lampshade furthermore has the advantage that the light of the LEDs in the lampshade can be guided to the outside in a targeted manner. The lampshade thus also serves as a light guide. By a suitable surface treatment or suitable configuration of the surface of the lampshade it is possible to couple the light out of the lampshade at a desired place. Thus, decorative purposes may be pursued.

Advantageously, the lampshade has a rotationally symmetrical configuration. Thus, a particularly uniform illumination and a particularly aesthetic overall impression are realized. Alternatively, other geometries of the luminaire are conceivable, too.

The lampshade may be formed of one layer or more layers, wherein the individual layers may have different properties. This permits an even more variable configuration of the light-guiding, respectively, refractive or light-extracting properties.

In another preferred embodiment of the present invention the surface of the lampshade is frosted at least in the area of the recess. This further optimizes the homogenous light distribution.

In another preferred embodiment of the present invention the surface of the lampshade has a defined surface structure, at least in the area of the recess, in particular a groove structure, nap structure or pyramid structure. Thus, different light distributions, light colors and illumination intensities can be realized so that the luminaire according to the invention has different technical and decorative application possibilities.

The lampshade according to the invention is preferably made of glass, and is mouth-blown or produced in a pressing process. Alternatively, also other materials are conceivable, e.g. plastic materials. Also, add-on elements, in particular of metal, may be assigned to the lampshade. For instance, a metal screen may be provided on the outer circumference of the lampshade to remove the glare from the luminaire.

In another preferred embodiment of the present invention the luminaire comprises a supporting plate on which the LEDs are arranged. This allows the precise arrangement of several LEDs outside the lampshade in the area of the recess. The supporting plate may additionally comprise other electric components and devices for fixing the luminaire. This results in a compact construction. Preferably, the LED, respectively, LED board can be screwed or glued to the supporting plate. Alternatively, other force fit, form fit or material bond connections are possible, too.

It has proved to be advantageous if the supporting plate is made, at least partially, of aluminum so as to dissipate the heat generated by the LED and guarantee an optimum function, respectively, operating mode of the LED. If the lampshade has a rotationally symmetrical configuration the LEDs can be arranged uniformly about an optical axis of the luminaire, along a circle, the optical axis coinciding with the axis of symmetry of the lampshade.

In another preferred embodiment of the present invention the supporting plate is embedded in the lampshade. This allows a further reduction of the overall height of the luminaire. Moreover, a particularly appealing visual appearance of the luminaire can thus be realized. In addition, it is possible to protect and seal the LED. To this end, a seal may be arranged between the supporting plate and the lampshade.

In another preferred embodiment of the present invention a stepped transition area is provided between the recess and the outer region of the lampshade. Thus, it is possible to embed the supporting plate in the lampshade in a particularly simple manner. Moreover, easy fixing possibilities of the lampshade to the supporting plate are thus realized, and to obtain a particularly easy and effective sealing a seal may be provided in the transition area between the lampshade and the supporting plate.

In another preferred embodiment of the present invention the supporting plate and the outside of the lampshade are flush. Thus, in the mounted state, the supporting plate follows the contour of the lampshade and fits in seamlessly with the design of the lampshade.

In another preferred embodiment of the invention the lampshade is screwed to the supporting plate. This guarantees a particularly easy installation of the luminaire. Preferably, the screws are arranged on the stepped transition area. Preferably, the height, width and shape of the lampshade and recess are chosen such that the screws are not visible in the mounted state of the luminaire, thereby creating an aesthetic overall impression. The bores on the lampshade necessary for the screws or alternative fixing devices are not in conflict with the closed light inlet end of the lampshade according to the invention. Alternatively, it is also possible to use a bayonet connection or threaded joint to fix the lampshade to the supporting plate.

The present invention furthermore provides for a lampshade for the luminaire according to the invention.

The invention is suited, in principle, for the most different luminaires. In particular, pendant luminaires, surface-mounted luminaires, built-in luminaires, or also spotlights may be configured according to the principle of the present invention.

BRIEF DESCRIPTION OF THE DRAWINGS

Advantageous embodiments of the present invention will be explained in more detail below by means of drawings. In the drawings.

DETAILED DESCRIPTION

In the following description like parts will be designated with like reference numbers. If a drawing includes reference numbers which are not referred to in more detail in the associated description of the figure, reference will be made to the preceding or subsequent description of the figure.

Figure 1:
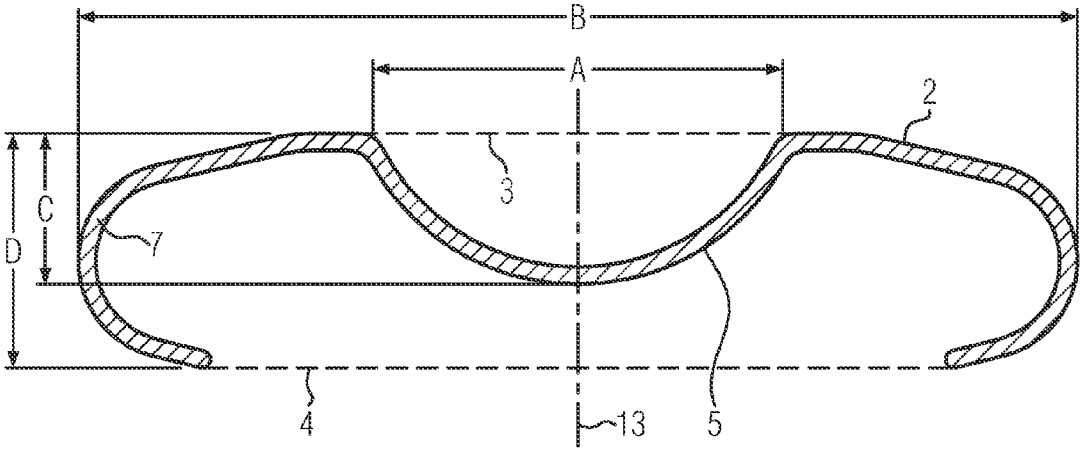
FIG. 1 shows a schematic sectional view of a lampshade according to the invention.

The lampshade 2 according to the invention, illustrated in FIG. 1, is designed for a pendant LED luminaire and has a rotationally symmetrical configuration relative to the axis 13. It comprises a closed light inlet end 3 and an open light outlet end with a light outlet opening 4. The outer region 7 of the lampshade is toroidal, and ensures an appealing appearance of the pendant luminaire. According to the invention the lampshade has a recess 5 in the region of the light inlet end. The recess is dome-shaped and points from the light inlet end 3 to the light outlet opening 4. It is arranged centrally above the light outlet opening. The width A of the recess approximately amounts to 40% of the width B of the lampshade. The height C of the recess in the illustrated embodiment approximately amounts to 70% of the height D of the lampshade. The height is measured from the light inlet end 3 to the highest point of the dome-shaped recess 5, respectively, to the light outlet end 4. The illustrated lampshade is made in one piece from pressed glass. It can be recognized that the lampshade has substantially the same wall thickness everywhere, in particular in the recess area.

Figure 2:
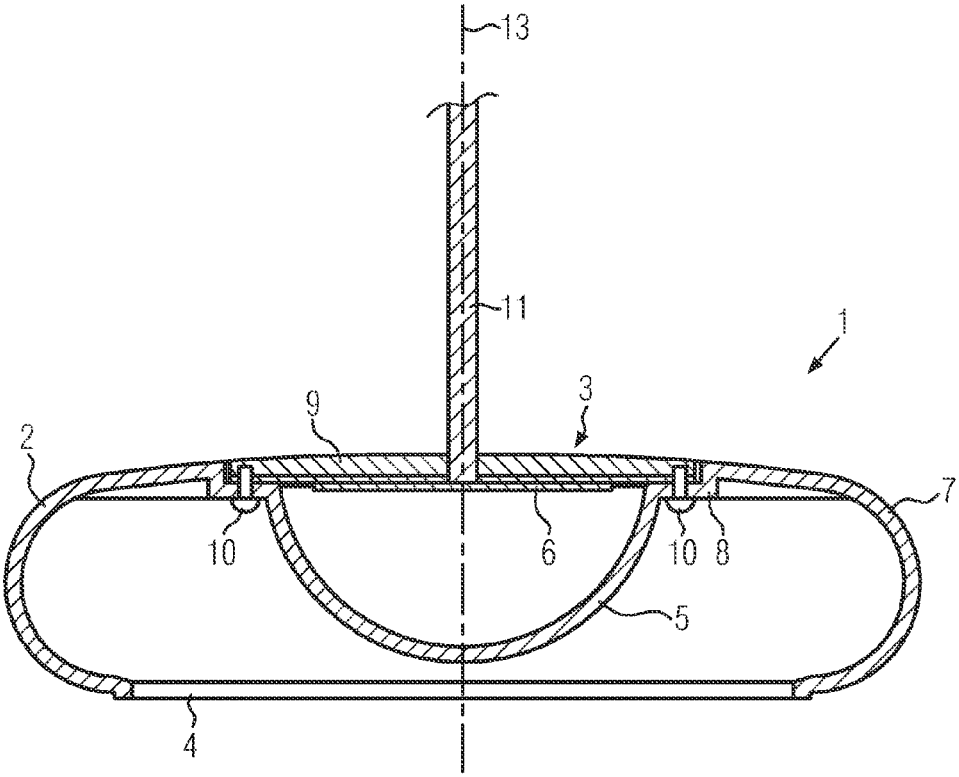
FIG. 2 shows a sectional view of a first embodiment of a luminaire according to the invention.

FIG. 2 shows a luminaire 1 according to the invention in the form of a pendant LED luminaire. The lampshade 2 of the luminaire has substantially the form of the lampshade illustrated in FIG. 1. In addition, a stepped transition area 8 is formed between the dome-shaped recess 5 and the toroidal outer region 7 of the lampshade. In this embodiment the height of the recess approximately amounts to 90% of the height of the lampshade. The width of the recess approximately amounts to 40% of the width of the lampshade.

An annular LED 6 serves as a light source and is received in the proximity of the light inlet end 3 in the recess 5 of the lampshade. The LED 6 is held by a supporting plate 9 which is embedded in the lampshade 2. Due to the stepped transition area 8 the supporting plate 9 is flush with the lampshade. The outer contour of the supporting plate 9 thus follows the shape of the lampshade 2. The supporting plate is screwed to the lampshade by means of several screws 10 and substantially seals the interior space of the recess. It is made of aluminum and, therefore, can rapidly dissipate the heat generated by the LED 6 to the outside. For fixing it to the ceiling the supporting plate 9 comprises a bar-shaped fixing element 11. It is pointed out that apart from the LED 6 all other electric and/or electronic components required for the operation of the luminaire may also be received in the recess. The other components may also be mounted on the supporting plate.

As the LED 6 is arranged in the proximity of the light inlet end 3 a relatively large distance is provided between the LED and the wall of the recess 5. The recess is furthermore frosted or provided with a special surface structure. Thus, the light emitted by the LED 6 is thoroughly mixed and distributed. A part of the mixed light is emitted directly through the light outlet opening 4 to the outside. Another part of the mixed light illuminates the outer region 7 of the lampshade from the inside. The lampshade also serves as a light guide. This means that the light is partially also transported through the glass of the lampshade to the outside. By means of a suitable surface configuration of the lampshade it is possible to couple the light out of the lampshade at a desired place.

Figure 3:
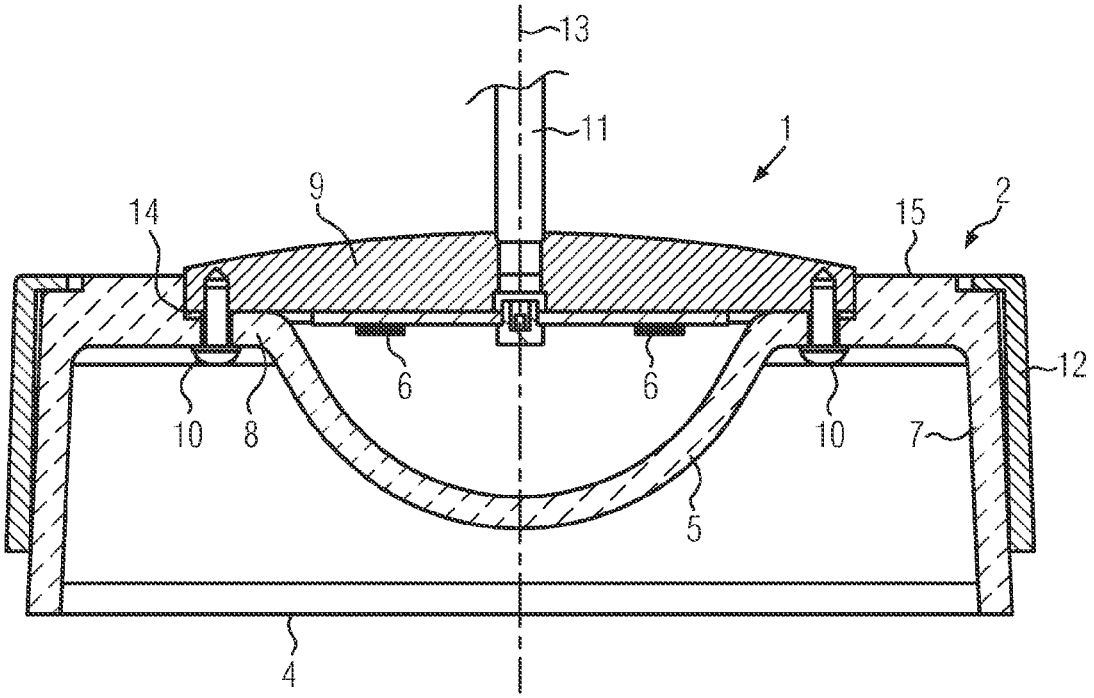
FIG. 3 shows a sectional view of a second embodiment of a luminaire according to the invention.

FIG. 3 shows another embodiment of a luminaire 1 according to the invention in the form of a pendant luminaire. As opposed to the embodiment shown in FIG. 2 the outer region 7 of the lampshade is cylindrical. In addition, the lampshade is partially enclosed by a hollow-cylindrical screen 12 of metal on the outside. The lampshade itself is therefore visible from the outside only in the area of the light outlet end. Looking on the lampshade from above an annular region 15 between the supporting plate 9 and the screen 12 is furthermore visible. A part of the light is emitted through this annular region 15 upwardly.

In this case, several LEDs 6 serve as light source, which are arranged uniformly about the axis 13 of the lampshade. In this embodiment, too, the LEDs are held by a supporting plate 9 embedded in the lampshade. Between the supporting plate 9 and the stepped region 8 of the lampshade, against which the supporting plate 9 rests, a seal 14 is provided to prevent dirt from penetrating into the dome-shaped recess 5 of the lampshade.

In this embodiment the height of the recess approximately amounts to 60% of the height of the lampshade. The width of the recess approximately amounts to 50% of the width of the lampshade.

The invention claimed is:

1. A luminaire comprising a light source in the form of at least one LED, and comprising a transparent lampshade having a closed light inlet end and an open light outlet end with a light outlet opening, the light source being arranged at the light inlet end, outside the lampshade, characterized in that the lampshade comprises a substantially convex shaped outer region and a substantially concave shaped inner region that is surrounded by the outer region, wherein the inner region forms a recess at the light inlet end which points to the light outlet opening.

2. The luminaire according to claim 1, wherein a height of the recess corresponds to at least 50% of a height of the lampshade.

3. The luminaire according to claim 2, wherein the height of the recess corresponds to at least 70% of the height of the lampshade.

4. The luminaire according to claim 1, wherein a width of the recess corresponds to at least 25% of a width of the lampshade.

5. The luminaire according to claim 1, wherein the recess is substantially spherical or dome-shaped.

6. The luminaire according to claim 1, wherein an outer region of the lampshade adjacent to the recess is substantially toroidal or cylindrical.

7. The luminaire according to claim 1, wherein the lampshade is made in one piece.

8. The luminaire according to claim 1, wherein the surface of the lampshade is frosted at least in the area of the recess.

9. The luminaire according to claim 1, wherein the surface of the lampshade has a defined surface structure, at least in the area of the recess.

10. The luminaire according to claim 1, wherein the luminaire comprises a supporting plate on which the LED is arranged.

11. The luminaire according to claim 10, wherein the supporting plate is embedded in the lampshade.

12. The luminaire according to claim 10, wherein a substantially stepped transition area is formed between the recess and the outer region.

13. The luminaire according to claim 10, wherein the supporting plate and the outside of the lampshade are flush.

14. The luminaire according to claim 10, wherein the lampshade is screwed to the supporting plate.

15. The luminaire according to claim 9, wherein the surface of the lampshade includes a groove structure, nap structure, or pyramid structure.

* * * * *